US009381672B2

(12) United States Patent
Outeiral-Somosa

(10) Patent No.: US 9,381,672 B2
(45) Date of Patent: Jul. 5, 2016

(54) TOOL AND METHOD FOR MOLDING CORNICES

(76) Inventor: Manuel Outeiral-Somosa, Morovis, PR (US)

( * ) Notice: Subject to any disclaimer, the term of this patent is extended or adjusted under 35 U.S.C. 154(b) by 516 days.

(21) Appl. No.: 13/493,149

(22) Filed: Jun. 11, 2012

(65) Prior Publication Data

US 2013/0328242 A1 Dec. 12, 2013

(51) Int. Cl.

| | |
|---|---|
| ***B28B 1/29*** | (2006.01) |
| ***B28B 19/00*** | (2006.01) |
| ***E04F 21/04*** | (2006.01) |
| ***E04F 21/16*** | (2006.01) |

(52) U.S. Cl.

CPC ..... *B28B 19/0046* (2013.01); *E04F 21/04* (2013.01); *E04F 21/161* (2013.01)

(58) Field of Classification Search

CPC ..... B28B 1/29; B28B 11/0809; E04F 21/16
USPC ..... 425/318, 458, 470
See application file for complete search history.

(56) References Cited

U.S. PATENT DOCUMENTS

| | | | | |
|---|---|---|---|---|
| 166,666 | A * | 8/1875 | Walter | 15/235.6 |
| 1,673,940 | A * | 6/1928 | Guarino | E04F 21/1655 15/235.6 |
| 5,203,885 | A * | 4/1993 | Pastre | E04F 19/02 264/267 |
| 6,729,088 | B2 * | 5/2004 | Corr | B25B 9/00 15/235.3 |
| 2012/0222230 | A1 * | 9/2012 | McNamara | 15/246.2 |

* cited by examiner

*Primary Examiner* — James Sanders
(74) *Attorney, Agent, or Firm* — Eugenio J. Torres; Victor Rodriuez-Reyes; Ferraiuoli LLC

(57) ABSTRACT

A tool and method for molding cornices comprising a sliding hand tool for the formation of cornices comprising a main body and a contact body, wherein the main body is attached to the contact body and wherein the main body is made of a light weight material and the contact body is made of a metal, such as stainless steel, for providing a smooth surface for the cornice. The method comprises the steps of placing a mesh on a foam molding and placing and shaping cement on the foam mold using a cornice hand float tool.

2 Claims, 4 Drawing Sheets

TOOL AND METHOD FOR MOLDING CORNICES

STATEMENT REGARDING FEDERALLY SPONSORED RESEARCH AND DEVELOPMENT

N/A

RELATED APPLICATIONS

N/A

BACKGROUND OF THE DISCLOSURE

1. Field of the Disclosure

The present disclosure relates generally to a new sliding hand tool for the formation of cornices along upper edges between the wall and the ceiling without the need to use complex machinery.

2. Discussion of the Background

The finishing of cornices or crown moldings during construction is a difficult, expensive and time-consuming process. In most cases, pre-constructed moldings are used to complete the cornices. Most moldings are made by machinery which limits the design, a design which in most cases is discontinued. Also it needs to be ordered, which affects construction time and therefore delays in the construction. Furthermore, some cornices are made of wood which requires more time to be prepared. Others are made of cement over a light weight structure, such as foam or plastic structure.

The use of current machinery for the preparation of cornices cannot be afforded by most construction workers or home owners. Most of the time companies are the only ones that can afford the machinery. Further and due to profit inquiries the companies limit cornice patterns or the possibilities of a customized design for a cornice.

Therefore, there is a need to provide a tool and method for molding cornices which overcomes the disadvantages and shortcomings of the prior art.

SUMMARY OF THE DISCLOSURE

The present disclosure overcomes the limitations of the previous tool and methods for molding a cornice. Accordingly, it is an object of the present disclosure to provide a light weight tool that is easy to use and capable of providing a smooth look for the cornice.

The first exemplary embodiment in accordance with the principles of the present disclosure comprises a hand tool comprising a main body and a contact body, wherein the main body is attached to the contact body and wherein the main body is made of a light weigh material and the contact body is made of a metal, such as stainless steel, for providing a smooth surface for the cornice.

It is another object of the present disclosure to provide a method for molding cornices without the use of expensive machinery. In accordance with the principles of the present disclosure the method for the construction of a cornice comprises placing a mesh on a foam molding and placing a substance that sets and hardens independently, such as cement, on the foam mold using the cornice hand float tool.

The disclosure itself, both as to its configuration and its mode of operation will be best understood, and additional objects and advantages thereof will become apparent, by the following detailed description of a preferred embodiment taken in conjunction with the accompanying drawings.

The Applicant hereby asserts, that the disclosure of the present application may include more than one disclosure, and, in the event that there is more than one disclosure, that these disclosures may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the disclosure of the application, which is measured by the claims, nor is it intended to be limiting as to the scope of the disclosure in any way.

BRIEF DESCRIPTION OF THE DRAWINGS

The accompanying drawings, which are incorporated herein, constitute part of the specifications and illustrate the preferred embodiment of the disclosure.

DESCRIPTION OF THE PREFERRED EMBODIMENT

Figure 1:
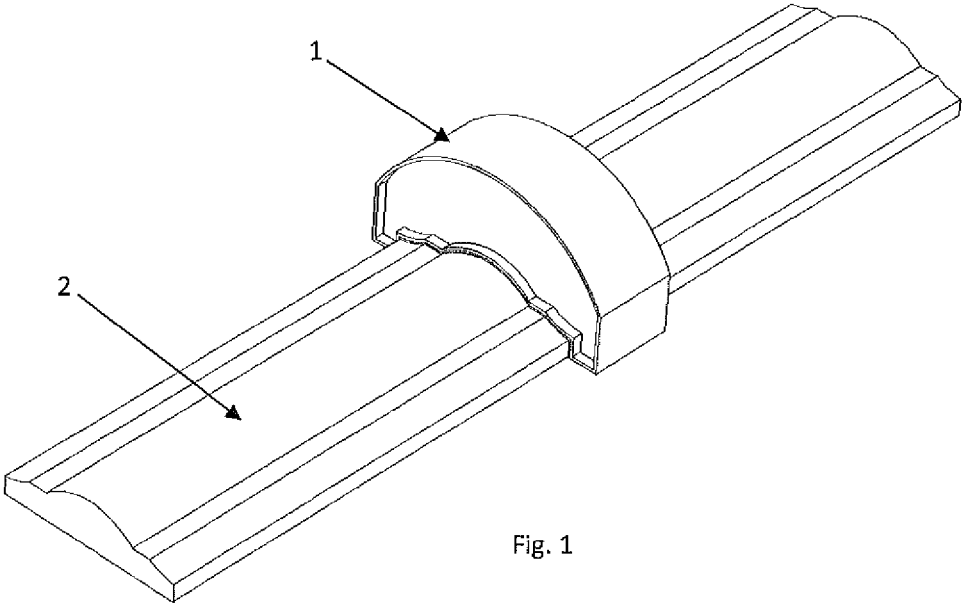
FIG. 1 shows a first general structure in accordance with the principles of the present disclosure.

Referring to FIG. 1, it shows a first exemplary general structure embodiment in accordance with the principles of the present disclosure. A first sliding hand tool 1 is located on top of a cornice light weight mold 2. The sliding tool is slid on top of the cornice light weight mold 2 for the formation of cornices along upper edges between the wall and the ceiling without the need of the use of complex machinery.

Figure 2:
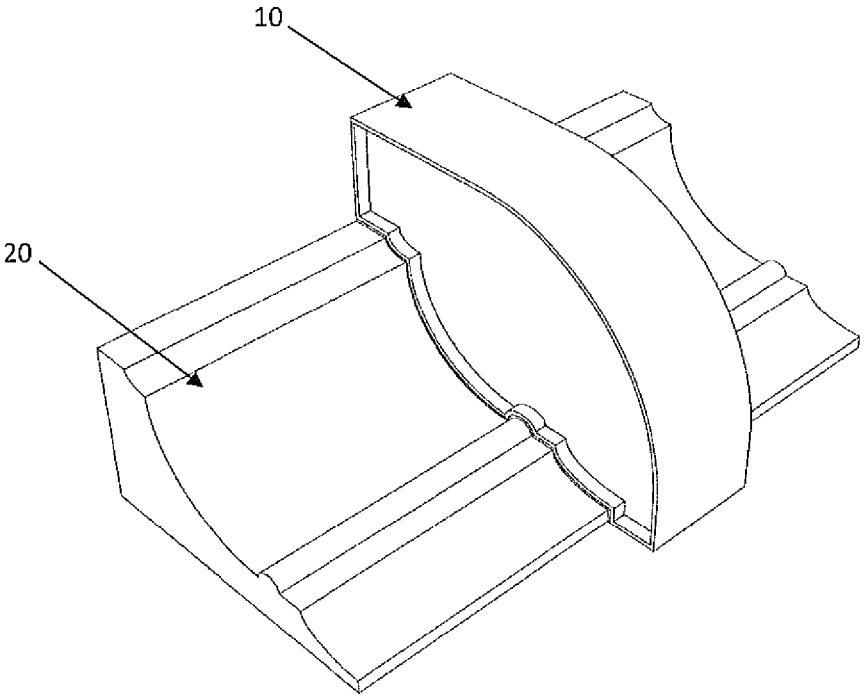
FIG. 2 shows a second general structure in accordance with the principles of the present disclosure.

FIG. 2 is directed to a second exemplary general structure embodiment in accordance with the principles of the present disclosure. A second sliding hand tool 10 is located on top of a second cornice light weight mold 20. In the same manner, as explained above, the second sliding tool 10 is slid on top of the second cornice light weight mold 20 for the formation of cornices along upper edges between the wall and the ceiling without need of the use of complex machinery.

FIG. 1 and FIG. 2 disclose, as mentioned, at least two parts. Therefore the process to complete a cornice comprises two main parts, the cornice hand tool 1, 10 and the light weight cornice mold 2, 20. The material of the mold is a light weight material, such as foam which is easy to carry. The selection of the material depends on several factors such as the environmental exposure of the cornice and/or the person which is going to be carrying the mold to place it along upper edges between the wall and the ceiling.

The light weight mold, if desired, can be configured to have a particular pattern or shape. The shape is selected by the user in most cases. In the instant case both light weight molds 2, 20 are curved. One advantage of selecting the proper material for the light weight mold 2, is that the selected material can be a material easy to be configured or shaped, such as foam.

Figure 3A:
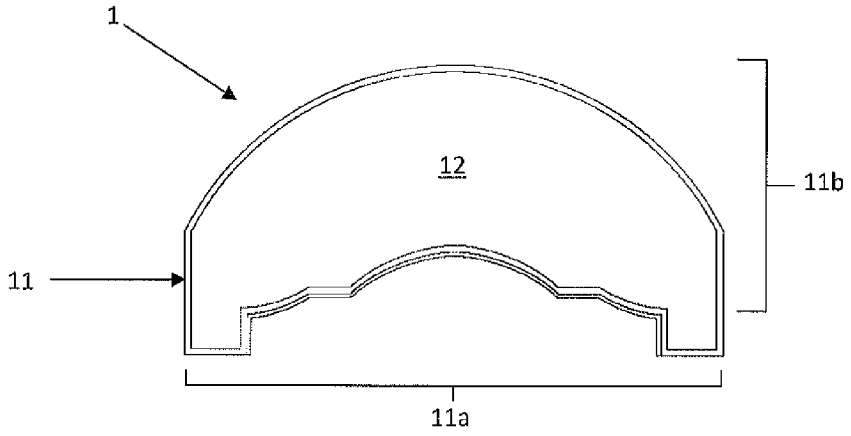
FIG. 3A-3D show the general structure of the first exemplary embodiment of the hand tool in accordance with the principles of the present disclosure.
Figure 3B:
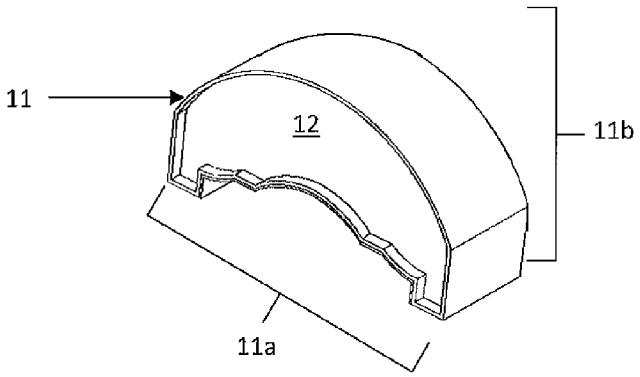
Figure 3C:
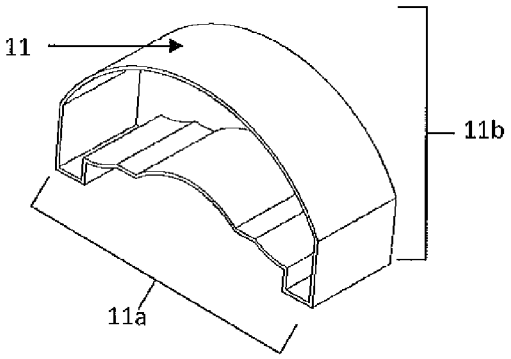

FIG. 3A through 3D are directed to the first exemplary hand tool 1. The first exemplary hand tool 1 comprises a main body 12 and a contact body 11. The main body 12 and contact body 11 are mechanically attached to each other by attaching means such as glue, screws, magnets or any other mean that holds or avoids any displacement between these two parts. FIG. 3A presents a front view of the first exemplary hand tool 1 wherein said contact body 11 is at least attached to a lower part of the main body 12. In the instant case the contact body 11 extends around the main body 12, as shown in FIG. 3B, however the main purpose of the contact body 11 is to be placed at the part of the main body that is closer to the light weight mold 2 during the molding process which is explained below. The contact body 11, as shown in FIG. 3C, comprises a lower part 11*a* which is configured to have a desired curved body. The desired curved body of the lower part resembles the cornice shape desired by the user. The contact body 11 further includes an extended body 11*b* which serves as a cover for the main body 12.

Figure 3D:
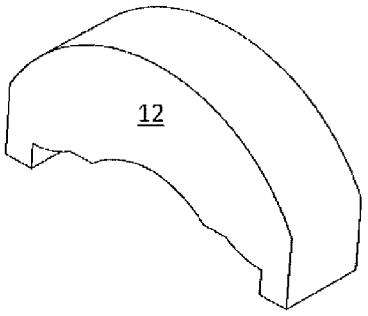

Further, the main body, as shown in FIG. 3D, may comprise a shape that fits inside the contact body 11. However, it has to be understood that the purpose of the main body 12 is to assist the user to handle the first hand tool 1. Therefore, the shape may vary, however both pieces need to be fixed to each other, as mentioned before, in such way that prevents any displacement between these two parts.

Figure 4A:
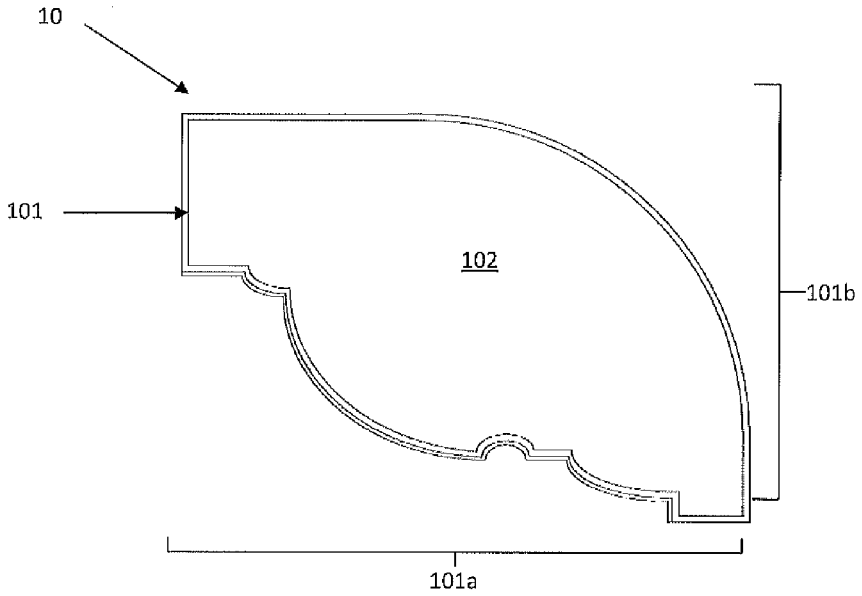
FIG. 4A-4D. show the general structure of the second exemplary embodiment of the hand tool in accordance with the principles of the present disclosure.
Figure 4B:
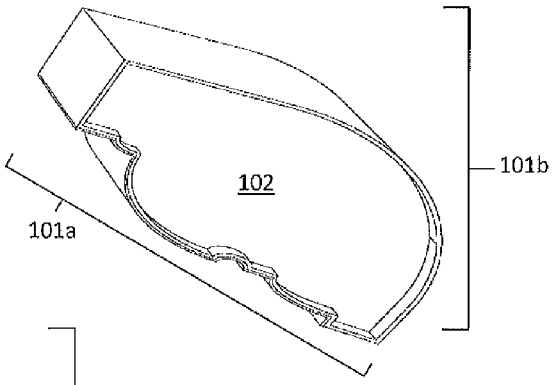
Figure 4C:
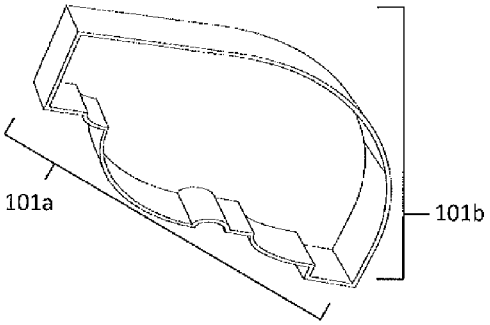

FIG. 4A through 4D are directed to the second exemplary hand tool 2. The second exemplary hand tool 2 comprises a second main body 102 and a second contact body 101. Similarly to the first exemplary hand tool 1, the second main body 102 and second contact body 101 are mechanically attached to each other by attaching means such as glue, screws, magnets or any other means that holds or avoids any displacement between these two parts. FIG. 4A presents a front view of the second exemplary hand tool 10 wherein said second contact body 101 is at least attached to a lower part of the main body 102. In the instant case the second contact body 101 extends around the main body 102, as shown in FIG. 4B, however, as explained above, the main purpose of the contact body 101 is to be placed at the part of the second main body 102 part that is closer to the light weight mold 2 during the molding process which is explained below. The contact body 11, as shown in FIG. 4C, comprises a second lower part 101*a* which is configured to have a desired curved body. The desired curved body of the lower part resembles the cornice shape desired by the user. The second contact body 101 further includes a second extended body 101*b* which serves as a cover for the main body 102.

Figure 4D:
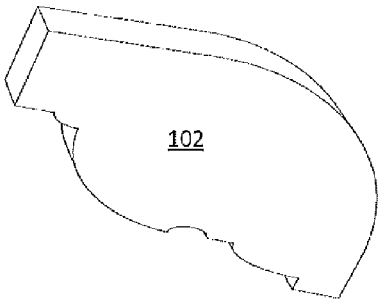

Further, the second main body 102, as shown in FIG. 4D, may comprise a shape that fits inside the second contact body 101. However, it has to be understood that the purpose of the main body 102 is to assist the user to handle the second hand tool 10. Therefore, the shape may vary, however both pieces need to be fixed to each other, as mentioned above, in such way that prevent any displacement between these two parts.

The main body 12, 102 for the first exemplary hand tool 1 and second exemplary tool 2 are made of a light weight material such as wood, plastic or any light weight resistant material. It is preferred to be a solid structure to avoid deformation of the main body, more particularly during the sliding procedure of the hand tool 1, 10 over the light weigh mold 2, 20.

The contact body 11, 101 for the first exemplary hand tool 1 and second exemplary tool 2 are made of a resistant material such stainless steel or any resistant material capable of providing a smooth surface over the light weight mold 2. The material should provide properties to avoid the cement to be attached to the lower part 11*a*, 101*a* surface.

Figure 5A:
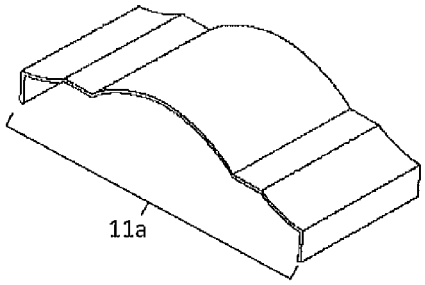
FIG. 5A-5B show an exemplary embodiment of the base plate of the first exemplary embodiment of the hand tool disclosure.
Figure 6A:
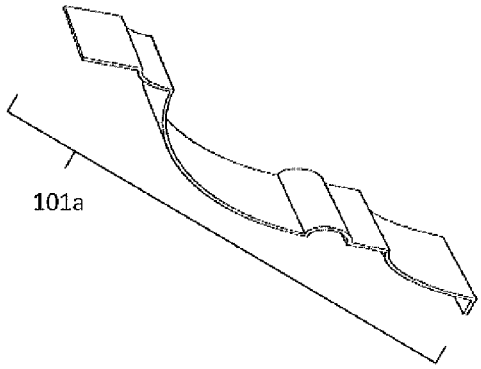
FIG. 6A-6B show an exemplary embodiment of the base plate of the first exemplary embodiment of the hand tool disclosure.
Figure 5B:
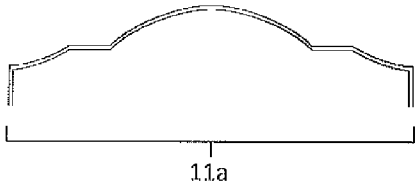
Figure 6B:
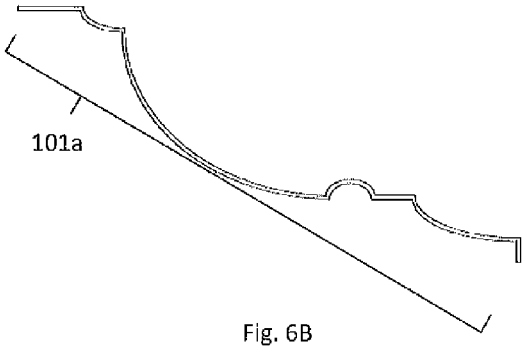

FIG. 5A through FIG. 5B clearly disclose the lower part 11*a* of the first hand tool 1. FIG. 6A through FIG. 6B clearly disclose the lower part 11*a* of the first hand tool 1. As mentioned above, the lower part is configured to resemble the cornice shape desired by the user. During the molding procedure, as described below, the lower part assists to shape the light weight molding.

Method for Molding a Cornice

After selecting a light weight mold 2, 20, as explained above, and selecting the preferred design for the lower part of the hand tool 1, 10 the user lays the mold on a surface, preferably a flat surface, to complete the molding procedure. The molding procedure comprises:

Step 1: Putting the Mesh on the Molding

1. Start adding adhesive, for example by spraying an adhesive, such as glue, on a mesh and the light weight mold 2, and carefully adhering the mesh to the top of the light weight mold 2, utilizing a flexible blade, such as a spatula, to make sure no gaps are formed.
2. Repeat same process until entire molding is covered with the mesh.

Step 2: Putting the Cement on the Molding

1. Place the top light weight mold 2 covered with the mesh on the table, which uses a tube as a guide for the stainless steel piece used to sheath the cement to the molding.
2. Pour cement on the light weight mold 2.
3. Slide the stainless steel hand tool 1, 10 (which has the form of the desired cornice), using the tube as a guide, on top of the light weight mold 2, so the cement covers the entire light weight mold 2.
4. Repeat process until entire molding has a generous and even coat of cement.
5. Wait three to four hours until cement is dried.
6. Repeat the coating process according to user's desired thickness for the light weight mold 2.

The disclosure is not limited to the precise configuration described above. While the disclosure has been described as having a preferred design, it is understood that many changes, modifications, variations and other uses and applications will, however, become apparent to those skilled in the art without materially departing from the novel teachings and advantages of this disclosure after considering this specification together with the accompanying drawings. Accordingly, all such changes, modifications, variations and other uses and applications which do not depart from the spirit and scope of the disclosure are deemed to be covered by this disclosure as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present disclosure, as well as equivalents thereof. The details in the patents, patent applications, and publications incorporated by reference herein may be considered to be incorporable at applicant's option, into the claims during prosecution as further limitations in the claims to patently distinguish any amended claims from any applied prior art.

I claim:

1. A hand tool floating device comprising:

a handle portion;

a main body comprising a first material and a contact body comprising a second material, wherein said contact body comprises a lower part and an extended body;

wherein said lower part comprises a first distal end and a first proximal end;

wherein said extended body comprises a second distal end and a second proximal end;

wherein said lower part and said extended body are attached creating a first space;

wherein said first distal end is attached to said second distal end, wherein said second distal end extends perpendicularly away from the lower part;

wherein said first proximal end is attached to said second proximal end, wherein said second distal end extends perpendicularly away from the lower part;

wherein said main body is positioned in said first space;

wherein said extended body serves as a cover for the main body;

wherein said main body comprises a solid structure to avoid deformation of the main body, wherein said solid structure comprises a constant shape to provide a close contact on the lower part; wherein the main body and contact body are mechanically attached to each other;

wherein said contact body surrounds said main body;

wherein the first material is different from the second material, wherein said difference is based on material strength;

wherein said first material is a light weight material;

wherein the second material is a resistant material;

wherein the lower part is configured to maintain constant curved shape resembling a cornice shape without any deformation.

2. A hand tool floating device as in claim 1, wherein the resistant material is stainless steel.

* * * * *